US006629677B2

(12) United States Patent
Kirshner

(10) Patent No.: US 6,629,677 B2
(45) Date of Patent: Oct. 7, 2003

(54) WRISTWATCH DISPLAY STAND

(75) Inventor: Harold Kirshner, New City, NY (US)

(73) Assignee: FADA Industries, Long Island City, NY (US)

( * ) Notice: Subject to any disclaimer, the term of this patent is extended or adjusted under 35 U.S.C. 154(b) by 9 days.

(21) Appl. No.: 10/122,716

(22) Filed: Apr. 15, 2002

(65) Prior Publication Data

US 2003/0071176 A1 Apr. 17, 2003

Related U.S. Application Data

(63) Continuation-in-part of application No. 29/149,538, filed on Oct. 11, 2001.

(51) Int. Cl.[7] ..... A47F 7/00
(52) U.S. Cl. ..... 248/116; 206/301; 211/85.2
(58) Field of Search ..... 248/442, 114, 248/115, 116; 206/566, 6.1, 301, 756, 461, 18; 211/41.1, 85.2; 40/642.01; D6/468, 466; 368/316, 278; 312/111; D9/420; D20/10, 19; 968/348, 349

(56) References Cited

U.S. PATENT DOCUMENTS

| | | | | |
|---|---|---|---|---|
| D141,791 S | | 7/1945 | Siegel | |
| 2,549,369 A | | 4/1951 | Epstein | |
| 2,647,623 A | * | 8/1953 | Ortendahl | 206/755 |
| 4,034,849 A | | 7/1977 | Zakrajsek | 206/45.15 |
| 4,082,183 A | | 4/1978 | Sturm | 206/301 |
| 4,216,858 A | | 8/1980 | Beauchamp | 206/45.15 |
| 4,362,402 A | * | 12/1982 | Kallinke et al. | 368/317 |
| 4,473,969 A | * | 10/1984 | Wilson | 46/1 R |
| 5,136,557 A | | 8/1992 | Plawker et al. | 368/316 |
| 5,181,608 A | | 1/1993 | Herzog | 206/301 |
| 5,377,822 A | | 1/1995 | Herzog | 206/45.14 |
| 5,579,906 A | | 12/1996 | Fabbri et al. | 206/301 |
| D379,758 S | | 6/1997 | Chu Lee | |
| 5,752,600 A | | 5/1998 | Kurashina et al. | 206/301 |
| 5,799,911 A | | 9/1998 | Dostie et al. | 248/116 |
| D409,416 S | | 5/1999 | Au | |
| 6,209,828 B1 | | 4/2001 | Au | 248/116 |
| 6,264,148 B1 | * | 7/2001 | Chandler | 248/116 |

* cited by examiner

*Primary Examiner*—Gwendolyn Baxter
(74) *Attorney, Agent, or Firm*—Brooks & Kushman P.C.

(57) ABSTRACT

A wristwatch display stand for displaying a wristwatch and a novelty item comprises a cuff member and a base. The wristwatch is attachable to the cuff member and the cuff member has a lower portion that includes a pair of spaced apart first configurations. The base has an upper portion adapted to receive the novelty item. The upper portion includes a pair of spaced apart complementary configurations sized to receive the first configurations. The first configurations extend about lateral sides of the novelty item to cooperate with the complementary configurations and affix the cuff member to the base while retaining the novelty item therebetween.

18 Claims, 3 Drawing Sheets

WRISTWATCH DISPLAY STAND

CROSS-REFERENCE TO RELATED APPLICATIONS

This application is a continuation-in-part of design application Ser. No. 29/149,538 which was filed on Oct. 11, 2001, now pending.

BACKGROUND OF THE INVENTION

1. Field of the Invention

The present invention relates to a wristwatch display stand for displaying and transporting a wristwatch and a novelty item such as a miniature skateboard.

2. Background Art

Merchants are continually looking for ways to better promote their products at the point of sale. Manufacturers are also continually looking for ways to better promote their products at the point of sale by providing a display or packaging that improves the promotion of their product. This is especially true when the goods at issue are wristwatches or other small articles which are typically displayed in a glass case amongst a plurality of similar articles. Typically, wristwatches are packaged such that the wristwatch may easily be put on display by merely removing the wristwatch and its display stand from the packaging, and placing it in the display case. When an individual wristwatch that is on display is sold, the wristwatch and display stand are simply placed back in the packaging and conveyed to the purchaser.

In the mindset of marketing and promotion, it is ideal if a product for sale draws the attention of the audience that the product is targeted for. Accordingly, if a wristwatch is produced for a particular target audience a display stand that catches the eye and draws the attention of a targeted buyer will improve sales by the promotion at the point of sale.

In the field of competitively priced sports wristwatches, the purchaser may not have a predetermined model of sports wristwatch or particular brand name in mind prior to the point of sale. It is advantageous for a manufacturer of sports wristwatches to provide a wristwatch display stand that will both promote the wristwatch by drawing the attention of the targeted audience to the display and sufficiently transport the article within its packaging.

It is the goal of the present invention to provide a simple low-cost wristwatch display stand for transporting an article such as a wristwatch that draws attention to the article at a point of sale display.

SUMMARY OF THE INVENTION

The wristwatch display stand of the present invention is for displaying both a wristwatch and a novelty item and includes a cuff member and a base. The cuff member is for attaching a wristwatch thereto and has a lower portion that includes a pair of spaced apart first configurations. The base has an upper portion adapted to receive the novelty item. The upper portion includes a pair of spaced apart complementary configurations. When a novelty item is received by the upper portion of the base, the first configurations extend about lateral sides of the novelty item to cooperate with the complementary configurations and affix the cuff member to the base. This cooperation between the first and complementary configurations of the cuff member and base respectively retains the novelty item therebetween.

DETAILED DESCRIPTION OF THE PREFERRED EMBODIMENT(S)

Figure 1:
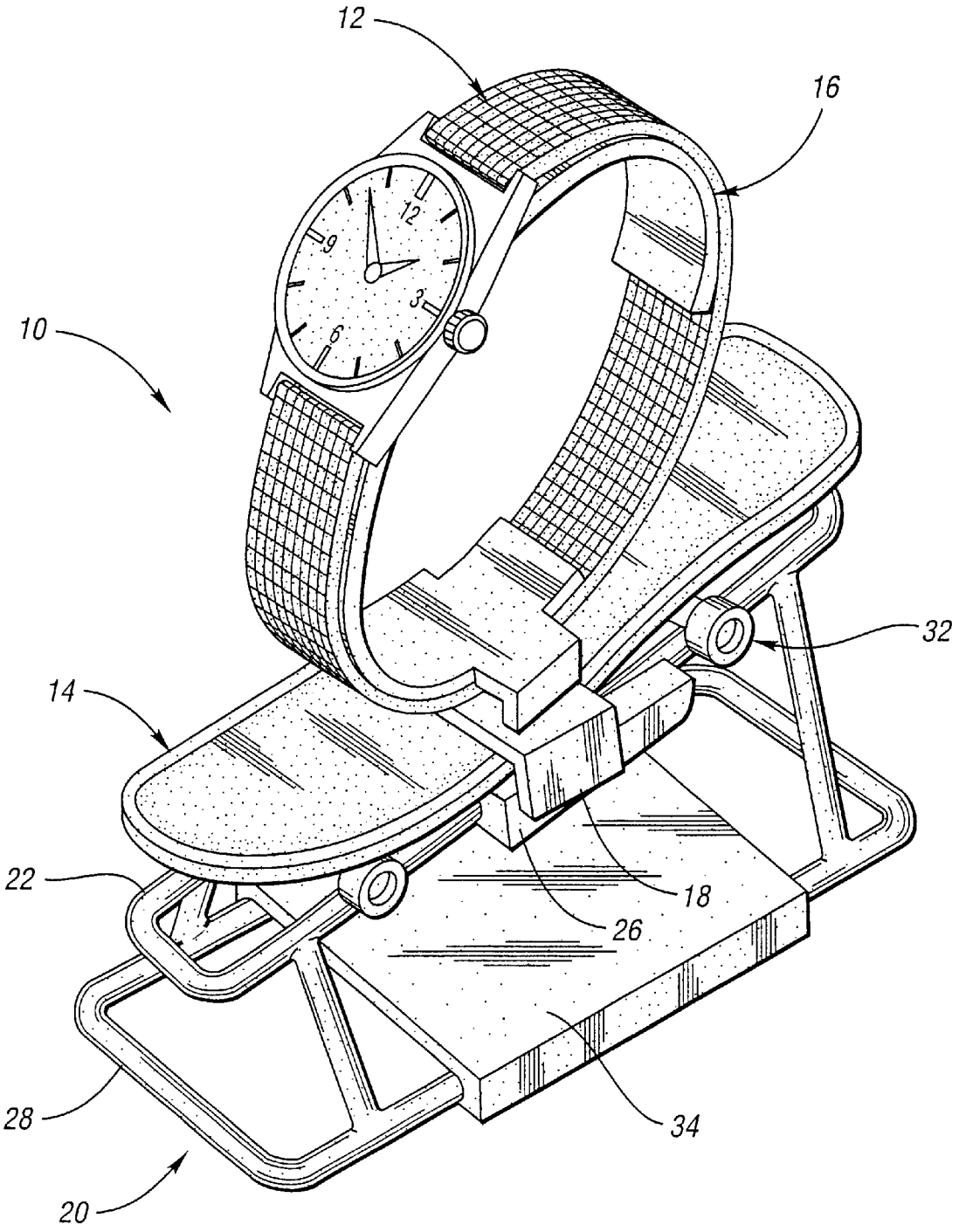
FIG. 1 is a perspective view of an exemplary embodiment wristwatch display stand for displaying a wristwatch and a novelty item.

FIGS. 1–4 illustrate an exemplary embodiment wristwatch display stand 10 for displaying a wristwatch 12 and a novelty item 14. The wristwatch display stand 10 benefits both the merchant and manufacturer by providing a point of sale display that is attractive to the targeted purchaser. Typically, the wristwatch display stand 10 will be displayed in a display case amongst a plurality of competitively priced and similar wristwatches. Ideally, the novelty item 14 attracts the attention of potential buyers, more particularly the targeted purchasers. In the field of competitively priced wristwatches, the potential buyer typically does not have a preferred wristwatch model or brand name. Accordingly, the wristwatch display stand 10 will increase sales of the article by promoting the product.

Particularly, in the field of sports wristwatches, a sport related novelty item 14 promotes the sale of the wristwatch 12. In a display case, including a plurality of wristwatches the novelty item 14 upsets the pattern of the display and draws focus to the displayed article.

Novelty item 14 is illustrated as a miniature skateboard. A miniature skateboard promotes the wristwatch 12 in an obvious manner because the purchase of the wristwatch 12 results in the procurement of both a wristwatch and a novelty miniature skateboard. Further, the miniature skateboard implies that wristwatch 12 is worn by participants of the sport, skateboarding. Not only does the display catch the eye of a potential purchaser, it targets sales towards cultures that are involved with the outdoor sport.

The invention contemplates that the novelty item 14 may be any miniature item representative of an audience or culture to be targeted for sale of the wristwatch. Accordingly, the novelty item may be representative of any outdoor activity or sport and may include but is not limited to a snow board, skis, roller blade, baseball bat, football helmet, hockey stick, basketball, or the like.

The wristwatch is attached to a cuff member 16. The cuff member 16 has a generally tubular c-shaped profile such that the wristwatch 12 may be easily attached to. Further, the cuff member 16 is formed of a resilient material such that a variety of wristwatches varying in size are also attachable thereto. The cuff member 16 is displaced above a lower portion 18 for projecting the wristwatch 12 generally upward for display at a location that is ideal for viewing.

The wristwatch display stand also includes a base 20 having a lower portion sized to be placed on a generally planar surface for displaying the wristwatch 12 and novelty item 14. The base 20 includes an upper portion 22 adapted to receive the novelty item 14 for presenting and displaying the novelty item 14 generally upward and away from the planar surface upon which the base 20 resides.

Lower portion 18 of the cuff member 16 includes a pair of spaced apart first configurations 24 for attaching the cuff member 16 to the base 20. Correspondingly, the upper portion 22 of the base 20 includes a pair of spaced apart complementary configurations 26 sized to receive first configurations 24.

Figure 2:
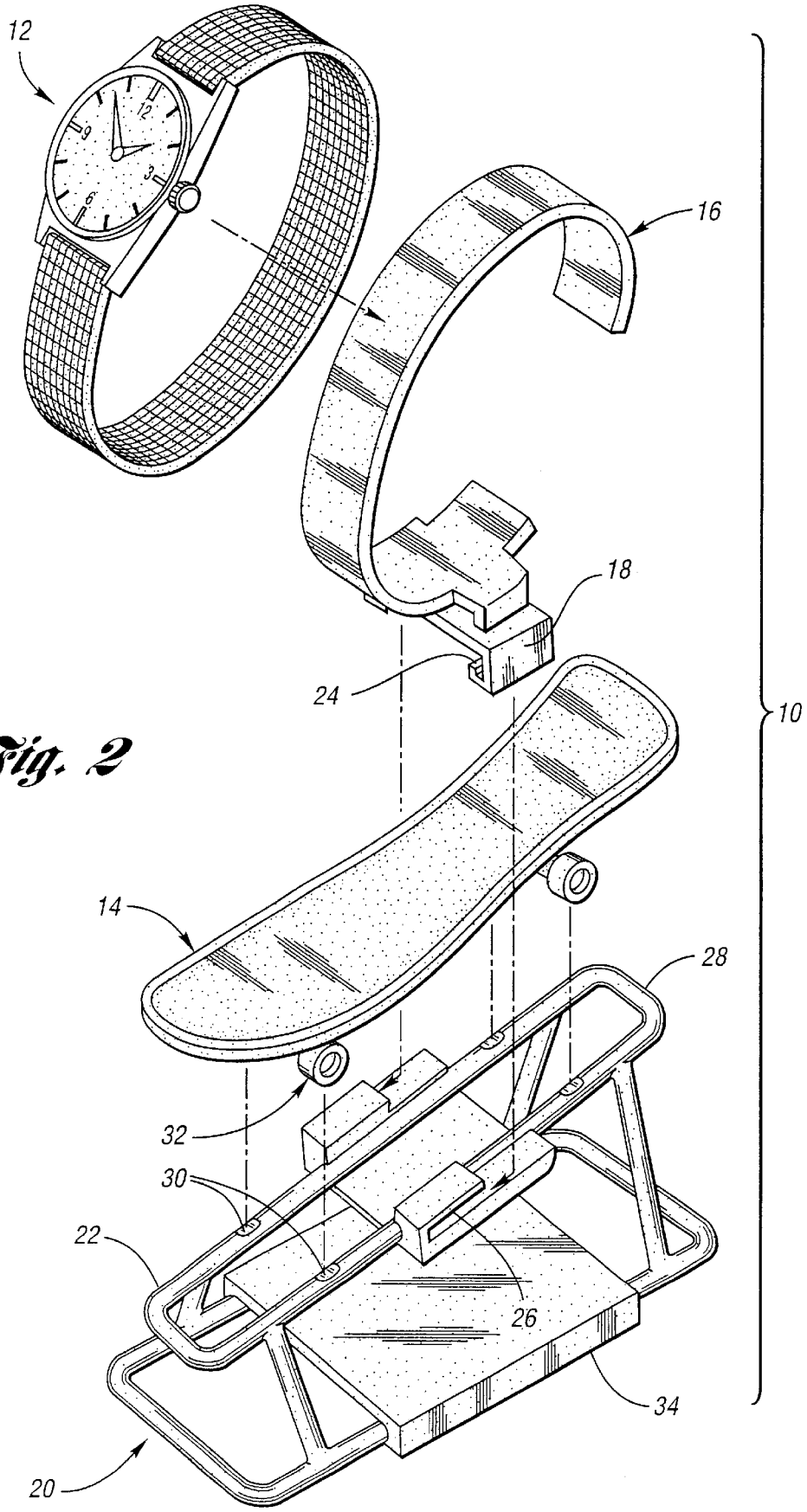
FIG. 2 is a partially exploded perspective view of the exemplary wristwatch display stand of FIG. 1.
Figure 3:
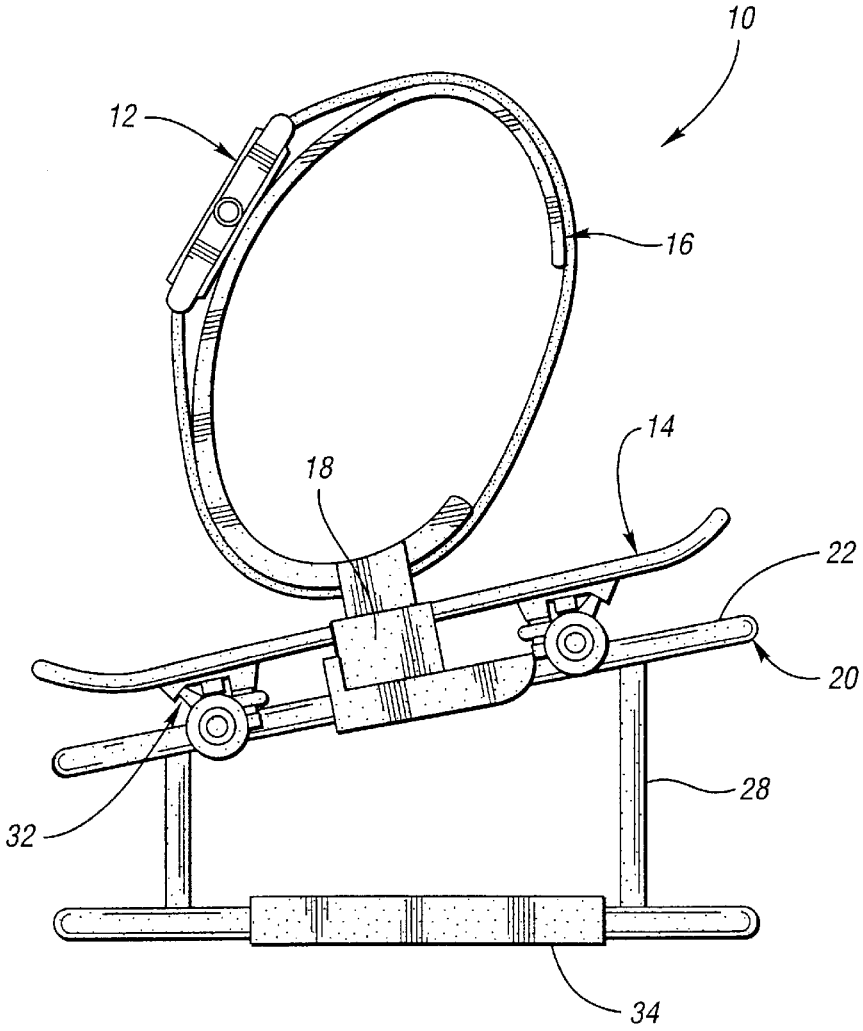
FIG. 3 is a right side elevational view of the exemplary wristwatch display stand of FIG. 1.
Figure 4:
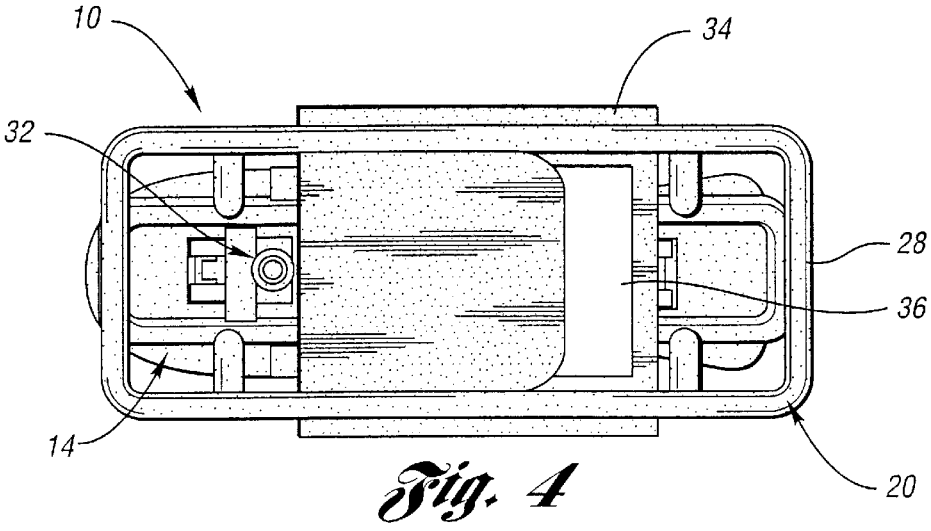
FIG. 4 is a bottom plan view of the exemplary wristwatch display stand of FIG. 1.

As shown in FIGS. 1 and 2, the first configurations 24 extend about lateral sides of the novelty item 14 to cooperate with the complementary configurations 26 for affixing the cuff member 16 to the base 20. Further, this cooperation retains the novelty item 14 therebetween the cuff member 16 and the base 20.

The base 20 is formed generally of a steel wire frame 28 that is coated with a shiny metallic or chrome-like surface for aesthetic and corrosion purposes. The wire frame 28 includes a plurality of recesses 30 formed within the upper portion 22 of the base 20. The recesses 30 are sized to receive trucks 32 of the miniature skateboard, the illustrated embodiment of novelty item 14, is retained on the base 20 in absence of the cuff member 16. Further, the recesses 30 align and position novelty item 14 to the upper portion 22 of the base 20.

The first configurations 24 are further defined as a pair of spaced apart L-shaped projections extending below the lower portion 18 of the cuff member 16 (as best shown in FIG. 2). Correspondingly, the complementary configurations 26 are further defined as a pair of generally L-shaped grooves sized to receive the first configurations 24. The complementary configurations 26 are formed within unitary plastic component that snaps upon the frame 28.

The first configurations 24 and complementary configurations 26 cooperate in a manner wherein the cuff member 16 is placed over the novelty item 14 such that the first configurations extend about the lateral sides of the novelty item 14. Then the cuff member 16 is pushed forward with respect to the novelty item 14 such that the first configurations 24 are inserted within the complementary configurations 26. The first and complementary configurations 24,26 are frictionally held together for retaining the cuff member 16 and novelty item 14 upon the base 20. Furthermore, the first configurations 24 are co-operable with the complementary configurations 26 in the absence of the novelty item 14.

The cuff member 16 may be formed of a transparent plastic material such that the cuff member 16 does not obstruct the view of the novelty item 14.

The base 20 further includes a booklet clip 34. The booklet clip 34 is formed of a plastic material that snaps onto a lower portion of the wire frame 28 such that the clip faces downward. Instruction booklet 36 is retained within the booklet clip 34. The booklet clip 34 conveniently retains the instruction booklet 36 with the wristwatch 12 for packaging and transporting purposes, yet also hides the instruction booklet for aesthetic and display purposes.

The wristwatch display stand 10 may be easily packaged within a typical cardboard box (not shown) for transporting purposes. Further, the cardboard box may include a window or opening formed therein aligned with the booklet clip 34 such that one may view the product name, model or price that may be displayed on the bottom of the booklet clip 34, without opening the cardboard box.

In accordance with the invention, the wristwatch display stand 10 may be packaged and transported within the cardboard box. At the point of sale, the wristwatch display stand 10 is simply removed from the cardboard box and presented within a typical display case. The wristwatch display stand 10 displays both the wristwatch 12 and the novelty item 14. The novelty item 14 provides the advantages of drawing attention to the wristwatch display stand 10, providing a wristwatch 12 accompanied by a novelty item 14, and attracting purchasers by implying that the field of the novelty item 14 is inhabitated by the wearer of the wristwatch 12.

While an embodiment of the invention has been illustrated and described, it is not intended that this embodiment illustrates and describes all possible forms of the invention. Rather, the words used in the specification are words of description rather than limitation, and it is understood that various changes may be made without departing from the spirit and scope of the invention.

What is claimed is:

1. A wristwatch display stand for displaying a wristwatch and a novelty item, the wristwatch display stand comprising:

a cuff member for attaching a wristwatch thereto, the cuff member having a lower portion that includes a pair of spaced apart first configurations; and a base having an upper portion adapted to receive the novelty item, the upper portion including a pair of spaced apart complementary configurations sized to receive the first configurations, wherein the first configurations extendable about lateral sides of the novelty item to cooperate with the complementary configurations and affix the cuff member to the base whereby the novelty item is retainable therebetween.

2. The wristwatch display stand of claim 1, further comprising a wristwatch attachable to the cuff member.

3. The wristwatch display stand of claim 1, wherein the upper portion of the base further comprises a plurality of recesses formed therein for securing the novelty item therein.

4. The wristwatch display stand of claim 1, wherein the cuff member is formed of a resilient material such that a variety of wristwatches varying in size are attachable thereto.

5. The wristwatch display stand of claim 1, wherein the cuff member is formed of a transparent plastic material such that the novelty item may be viewed through the cuff member.

6. The wristwatch display stand of claim 1, wherein the base is formed of a steel material and the complementary configurations are formed of a plastic material and affixed to the base.

7. The wristwatch display stand of claim 1, further comprising a novelty item received by the upper portion of the base and retained by the cooperation of the first and complementary configurations.

8. The wristwatch display stand of claim 7, wherein the novelty item is further defined as a miniature skateboard.

9. A wristwatch display stand for displaying a wristwatch and a miniature skateboard, the wristwatch display stand comprising:

a cuff member for attaching the wristwatch thereto, the cuff member having a lower portion that includes a pair of spaced apart first configurations; and a base having an upper portion adapted to receive the miniature skateboard, the upper portion including a pair of spaced apart complementary configurations sized to receive the first configurations, wherein the first configurations extendable about lateral sides of the miniature skateboard to cooperate with the complementary configurations and affix the cuff member to the base whereby the miniature skateboard is retainable therebetween.

10. The wristwatch display stand of claim 9, further comprising a wristwatch attachable to the cuff member.

11. The wristwatch display stand of claim 9, further comprising a miniature skateboard received by the upper portion of the base and retained by the cooperation of the first and complementary configurations.

12. The wristwatch display stand of claim 9, wherein the upper portion of the base further comprises a plurality of recesses formed therein for securing the miniature skateboard therein.

13. The wristwatch display stand of claim 9, wherein the cuff member is formed of a resilient material such that a variety of wristwatches varying in size are attachable thereto.

14. The wristwatch display stand of claim 9, wherein the cuff member is formed of a transparent plastic material such that the miniature skateboard may be viewed through the cuff member.

15. The wristwatch display stand of claim 9, wherein the base is formed of a steel material and the complementary configurations are formed of a plastic material and affixed to the base.

16. A wristwatch display stand for displaying a wristwatch and a miniature skateboard, the wristwatch display stand comprising:

a wristwatch;

a cuff member for attaching the wristwatch thereto;

a miniature skateboard; and a base having an upper portion adapted to receive the miniature skateboard wherein the cuff member is affixal to the base whereby the miniature skateboard is retained therebetween.

17. A wristwatch display stand for displaying a wristwatch and a novelty item, the wristwatch display stand comprising:

a wristwatch;

a cuff member for attaching the wristwatch thereto, the cuff member having a lower portion that includes a pair of spaced apart first configurations;

a novelty item; and a base having an upper portion adapted to receive the novelty item, the upper portion including a pair of spaced apart complementary configurations sized to receive the first configurations, wherein the first configurations extend about lateral sides of the novelty item to cooperate with the complementary configurations and affix the cuff member to the base whereby the novelty item is retained therebetween.

18. A wristwatch display stand for displaying a wristwatch and a miniature skateboard, the wristwatch display stand comprising:

a wristwatch;

a cuff member for attaching the wristwatch thereto, the cuff member having a lower portion that includes a pair of spaced apart first configurations;

a miniature skateboard; and a base having an upper portion adapted to receive the miniature skateboard, the upper portion including a pair of spaced apart complementary configurations sized to receive the first configurations, wherein the first configurations extend about lateral sides of the miniature skateboard to cooperate with the complementary configurations and affix the cuff member to the base whereby the miniature skateboard is retained therebetween.

* * * * *